US007695060B2

(12) United States Patent
Dubiel et al.

(10) Patent No.: US 7,695,060 B2
(45) Date of Patent: Apr. 13, 2010

(54) SWING TRAY FOR A CHILD BOOSTER SEAT

(75) Inventors: David Dubiel, Goffstown, NH (US); Janet Levenson, Goffstown, NH (US)

(73) Assignee: Optilife Products, Inc., Goffstown, NH (US)

( * ) Notice: Subject to any disclaimer, the term of this patent is extended or adjusted under 35 U.S.C. 154(b) by 32 days.

(21) Appl. No.: 11/503,043

(22) Filed: Aug. 11, 2006

(65) Prior Publication Data

US 2008/0122270 A1 May 29, 2008

(51) Int. Cl.
*A47B 83/02* (2006.01)

(52) U.S. Cl. ..... 297/148; 297/150; 297/155

(58) Field of Classification Search ..... 297/148, 297/250.1, 256.13, 150, 154, 155, 173, 188.15, 297/188.188, 256.15, 153; 33/495; 403/52, 403/119; 108/4, 2, 139, 142
See application file for complete search history.

(56) References Cited

U.S. PATENT DOCUMENTS

| | | | | | |
|---|---|---|---|---|---|
| 113,402 | A | | 4/1871 | Crandall, Jr. | |
| 187,680 | A | * | 2/1877 | Taylor | 297/150 |
| 451,058 | A | | 4/1891 | Koeser | |
| 686,914 | A | * | 11/1901 | Stark | 297/242 |
| 1,140,211 | A | * | 5/1915 | Thomas | 297/76 |
| 1,324,503 | A | | 12/1919 | Hirsch | |
| 1,983,138 | A | * | 12/1934 | Lehman | 297/149 |
| 2,704,116 | A | * | 3/1955 | Scanlon | 297/150 |
| 2,746,526 | A | * | 5/1956 | Loeschnigg et al. | 297/161 |
| 2,799,324 | A | * | 7/1957 | Anderson | 297/145 |
| 3,632,163 | A | * | 1/1972 | Burnham | 297/155 |
| 4,591,206 | A | * | 5/1986 | Pribble | 297/148 |
| 4,795,209 | A | | 1/1989 | Quinlan, Jr. et al. | |
| 4,852,940 | A | * | 8/1989 | Kanigowski | 297/145 |
| 5,026,114 | A | * | 6/1991 | Miller | 297/145 |
| 5,106,156 | A | * | 4/1992 | Marquis | 297/153 |
| 5,609,389 | A | * | 3/1997 | Longoria et al. | 297/37 |
| 5,649,737 | A | | 7/1997 | Behnke | |
| D383,911 | S | | 9/1997 | Conforti et al. | |
| 5,899,526 | A | | 5/1999 | LaPointe et al. | |
| 5,984,791 | A | | 11/1999 | Fair et al. | |
| 5,992,932 | A | * | 11/1999 | Kain et al. | 297/153 |
| 6,033,019 | A | * | 3/2000 | Hession-Kunz et al. | 297/250.1 |
| 6,419,312 | B1 | * | 7/2002 | Flannery et al. | 297/149 |
| 6,520,587 | B2 | * | 2/2003 | Noiseux | 297/411.37 |
| 6,692,070 | B1 | * | 2/2004 | Hou et al. | 297/153 |
| D497,261 | S | | 10/2004 | Epp et al. | |
| 7,104,603 | B2 | * | 9/2006 | Keegan et al. | 297/256.13 |
| 2006/0250005 | A1 | * | 11/2006 | Keegan et al. | 297/256.13 |
| 2007/0145790 | A1 | * | 6/2007 | Ventrola | 297/151 |

* cited by examiner

*Primary Examiner*—David Dunn
*Assistant Examiner*—James Alex
(74) *Attorney, Agent, or Firm*—Daniels Patent Law PLLC; Scott A. Daniels

(57) ABSTRACT

A booster seat (1) for children and infants and more particularly an improved feeding seat contains a tray (9) which can rotate around either arm of the seat (1) through a unique joint design. The tray (9) can be removed completely or used as a multi-position tray (9), whichever the operator prefers. Further, the tray (9) can be adjusted to fit smaller or larger occupants of the booster seat (1).

8 Claims, 9 Drawing Sheets

SWING TRAY FOR A CHILD BOOSTER SEAT

FIELD OF THE INVENTION

This invention relates to a booster seat and feeding tray for supporting infants, toddlers or children and more particularly to a new and improved booster seat and swiveling feeding tray which swivels along two independent axes on either side of the booster seat.

BACKGROUND OF THE INVENTION

A number of improvements have been made in the booster seat art in recent years. More recently, improvements and modifications have been made to booster seats and feeding seats with feeding trays which allow a child to enter horizontally rather than vertically. Some of these booster chairs allow for complete removal of the feeding tray, only to reinsert the tray once the child was in their desired position. Other designs hinged the feeding tray with a single swivel only at one end and allow the rotation of the tray such that the child could enter the seating area, and the tray subsequently rotated back to its original position to lock into position and contain the child. These single swivel trays have been temporarily fixed at one end and hinged at the other allowing for little adjustability beyond the ability to rotate the feeding tray about a single axis.

U.S. Pat. No. 4,795,209 (hereinafter Quinlan '209) shows such technology in a portable baby carrier arrangement wherein a feeding tray is adapted to be removably attached at one end and hinged about an axis at the other. The tray opens vertically, that is, up and to the side relative to a seated child, and cannot be adjusted to account for the different size of potential child occupants. A rotating bar defines the rotation axis and also functions as a handle mechanism or as a brace. Importantly, Quinlan '209 can open only along the side opposite to the rotation axis and does not permit the adjustability of a multi-position tray.

Similarly, U.S. Pat. No. 451,058 (hereinafter Koeser '058) discloses a single swivel design that may be rotated along the horizontal or vertical axes only on one side of the chair. The free end of the tray is attachable at the respective opposing arm of the chair, but in no manner does Koeser '058 teach the ability to rotate the tray either vertically or horizontally along that arm to which the free end is attached.

That arrangement is shown in U.S. Pat. No. 113,402 (hereinafter Crandall '402). Crandall '402 discloses a baby carriage in which a barrier is hinged at both ends by a shaft and slot design. A shaft is shown extending upwards from both arms of the carriage and the barrier contains slots or bores configured to receive the vertically extending shafts, such that hinging is not possible when both shafts are engaged in their respective slots. For the barrier to swivel at either end, the barrier must be removed from both shafts, and only one shaft subsequently engaged into its respective slot. The barrier cannot be re-engaged without inserting both shafts into their respective slots either simultaneously or with significant deformation to one of the shafts. Further, Crandall '402 cannot adjust the horizontal placement of the barrier relative to a child occupant of the seat.

A similar design is disclosed in U.S. Pat. No. 1,140,211 (hereinafter Thomas '211) wherein a swing contains a tray pivotably connected at one end and configured to be attached at the other. The removably attached end contains a slot and shaft-like arrangement, but similar to Crandall '402, cannot independently rotate at either end and does not provide adjustability to account for a different sized occupant.

Several prior art patents have disclosed a single-swivel tray adapted to be attached to the arm of a chair, table or other base member. U.S. Pat. No. 5,899,526 discloses a single-swivel tray removably attached to an arm member for the purposes of providing health care. U.S. Pat. No. 5,649,737 discloses a similar single-swivel tray wherein the tray can be detached from a base member by the simple removal of two clips. Further, U.S. Pat. No. 1,324,503 discloses a single-swivel tray which can rotate away from the chair's occupant such that the occupant may place food on the tray and sit in the chair. The tray is subsequently rotated toward the occupant so the food may be accessed in a more comfortable dining fashion. U.S. Pat. No. 686,914 discloses a combination seat wherein single-swivel trays horizontally swing away from one fixed hinge. The seats contain book holders and other scholarly conveniences and are supported by a single post member.

SUMMARY OF THE INVENTION

Wherefore, it is an object of the present invention to overcome the above mentioned shortcomings and drawbacks associated with the prior art.

It is another object of the present invention to provide a dual swivel system in a booster chair such that the feeding tray may rotate about a connection with either of the opposing arms of the booster chair.

Another important object of the present invention is to provide a connection with both of the opposing arms of the booster chair which enables a symmetrical adjustment the feeding tray relative to a child occupant of the booster seat.

A still further object of the invention is to provide a connection with both of the opposing arms of the booster chair wherein the connection enables both the action of sliding adjustment along the arms of the feeding tray and swiveling of the feeding tray about either of the opposing arms.

Another object of the present invention is to provide a feeding seat and dual sided swinging feeding tray that is relatively inexpensive to manufacture and which, therefore, may be sold for a modest price while providing maximum convenience and versatility to its owner.

Another object of the present invention is to provide a booster seat for facilitating the feeding of an infant or child comprising a seat portion, a back support portion, a pair of arm rests and a tray having a first and a second spaced apart swivel joints wherein the first and second swivel joints are pivotally and releasably engaged with a respective opposing arm rest of the booster seat to permit rotation of the tray about either of the pair of arm rests.

Still another object of the present invention is to provide a swivel joint for attaching a tray to a support member, the swivel joint comprising an engagement member, an engagement member receiver formed in the tray, a first rotational axis defined by a rotational engagement between the engagement member and receiver in the tray and wherein the engagement member comprises a first and a second relatively movable attachment portions to facilitate engagement and disengagement with the support member.

Yet another object of the present invention is to provide a method of attaching a tray to a support member via a swivel joint, the method comprising the steps of forming an engagement member, engaging the engagement member in an engagement member receiver formed in the tray to define the swivel joint, providing a first rotational axis defined by a rotational engagement between the engagement member and receiver in the tray to permit relative rotation between the engagement member and the receiver and forming the engagement member comprised of a first and a second relatively movable attachment portions to facilitate engagement and disengagement with the support member.

To accomplish these and other objects, the feeding seat of the present invention is made up of three major components, including the seat itself, the feeding tray, and the connections whereby the feeding tray is releasably coupled on both arm of the booster seat.

These and other objects and features of the present invention will be better understood and appreciated from the following detailed description of the preferred embodiment thereof, shown in the accompanying drawings.

BRIEF DESCRIPTION OF THE DRAWINGS

The invention will now be described, by way of example, with reference to the accompanying drawings in which.

DETAILED DESCRIPTION OF THE INVENTION

Figure 1:
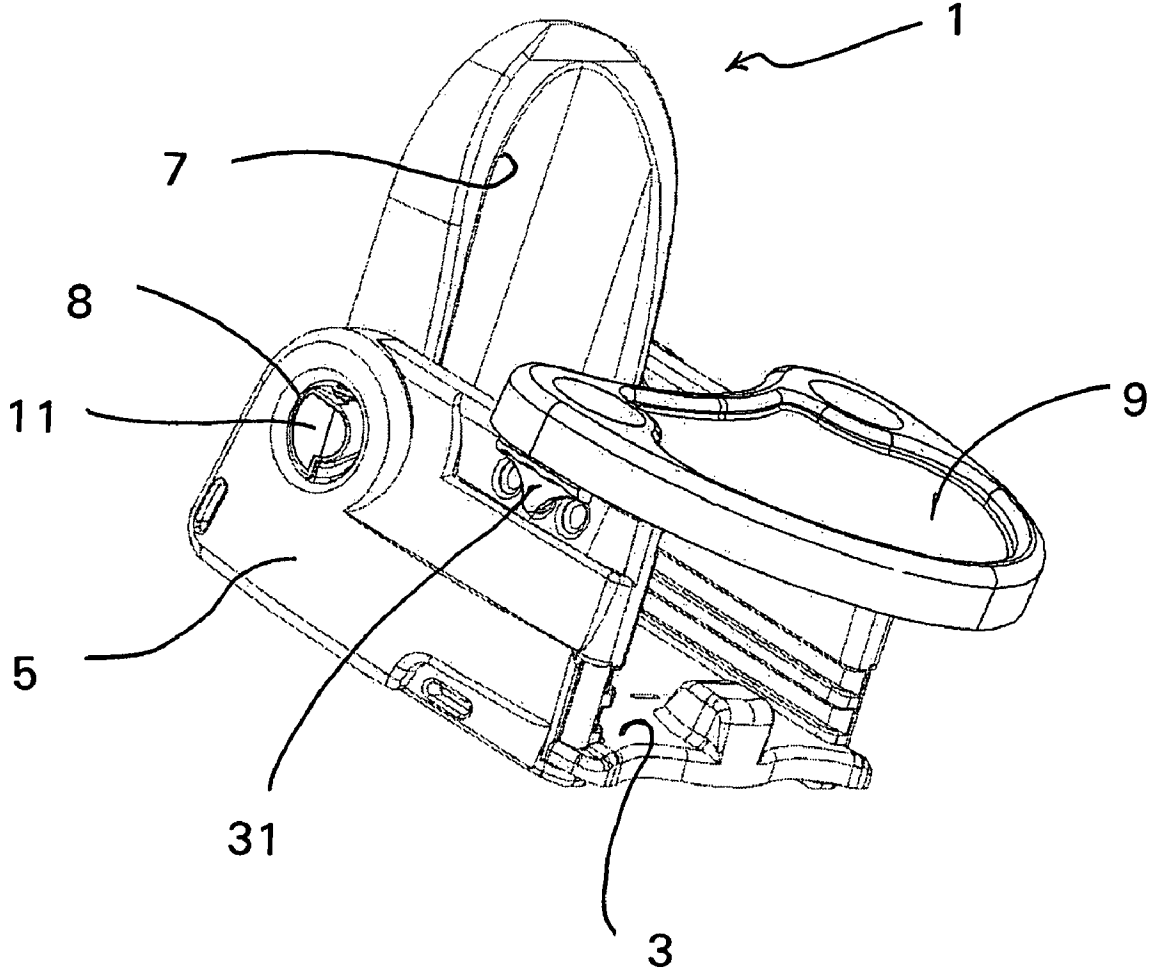
FIG. 1 is a perspective view of one embodiment of the assembled booster chair and swing tray.

Observing FIG. 1, a brief description concerning the various components of the present invention will now be discussed. As can be seen in this embodiment, an child booster seat 1 is comprised of a number of features, in general, a seat member 3 upon which a child would be seated is adjustably connected to a pair of opposing arm rests 5, and a back member 7 is also adjustably attached to the pair of arms 5 via a pair of opposing hinge points 8 defining an axis of rotation for the back member 7. A pivotable feeding tray 9 is connected to the arm rests 5 for holding food, utensils, toys, etc., or other items in front of the seated child and for use in feeding the child.

By way of general description, the back member 7 of the booster seat 1 is attached via the hinge points 8 to the opposing arm rests 5 and while generally aligned in a relative perpendicular manner to the seat member 3, the back member 7 can be adjusted in a variety of ways about a hinge axis A defined by the hinge points 8 relative to the seat member 3 and the arm rests 5. This rotation facilitates alternative positions of the booster and feeding chair 1. For example, to accommodate collapsing of the booster seat 1 for storage or travel or for attaining a specific position for feeding an infant, the back member 7 can be rotated about the hinge axis A. For storage, the back member 7 can rotate forward about the hinge axis A to rest in a parallel planar relation with the seat member 3 such that the embodiment is compact and easily transportable.

While the hinge can be produced in a variety of ways, the present embodiment discloses a protrusion 11 extending from both sides of the back member 7. The protrusion 11 is engaged with a cavity or passage formed in the respective arm rests 5 so as to captively retain the protrusion 11 therein and permit a desired range of motion of the back member 7 relative to the arm rests 5, and seat member 3. The protrusions 11 and the cavity or passage 13 define a hinge axis A about which the back member 7 rotates relative to the seat member 3 and the arm rests 5.

Figure 3:
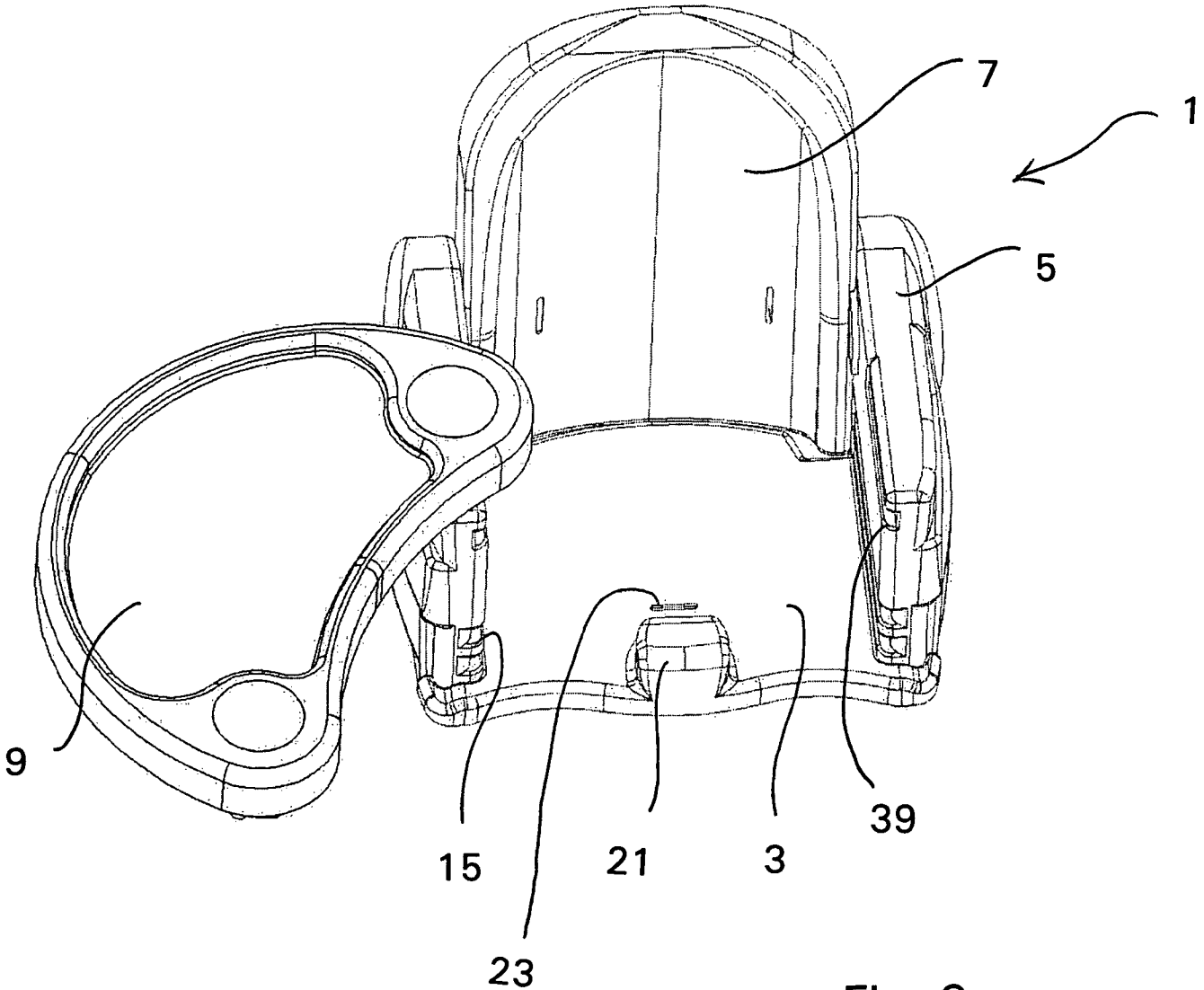
FIG. 3 is a still further perspective view of the booster seat and swing tray in a partially open configuration to the opposing side.
Figure 4:
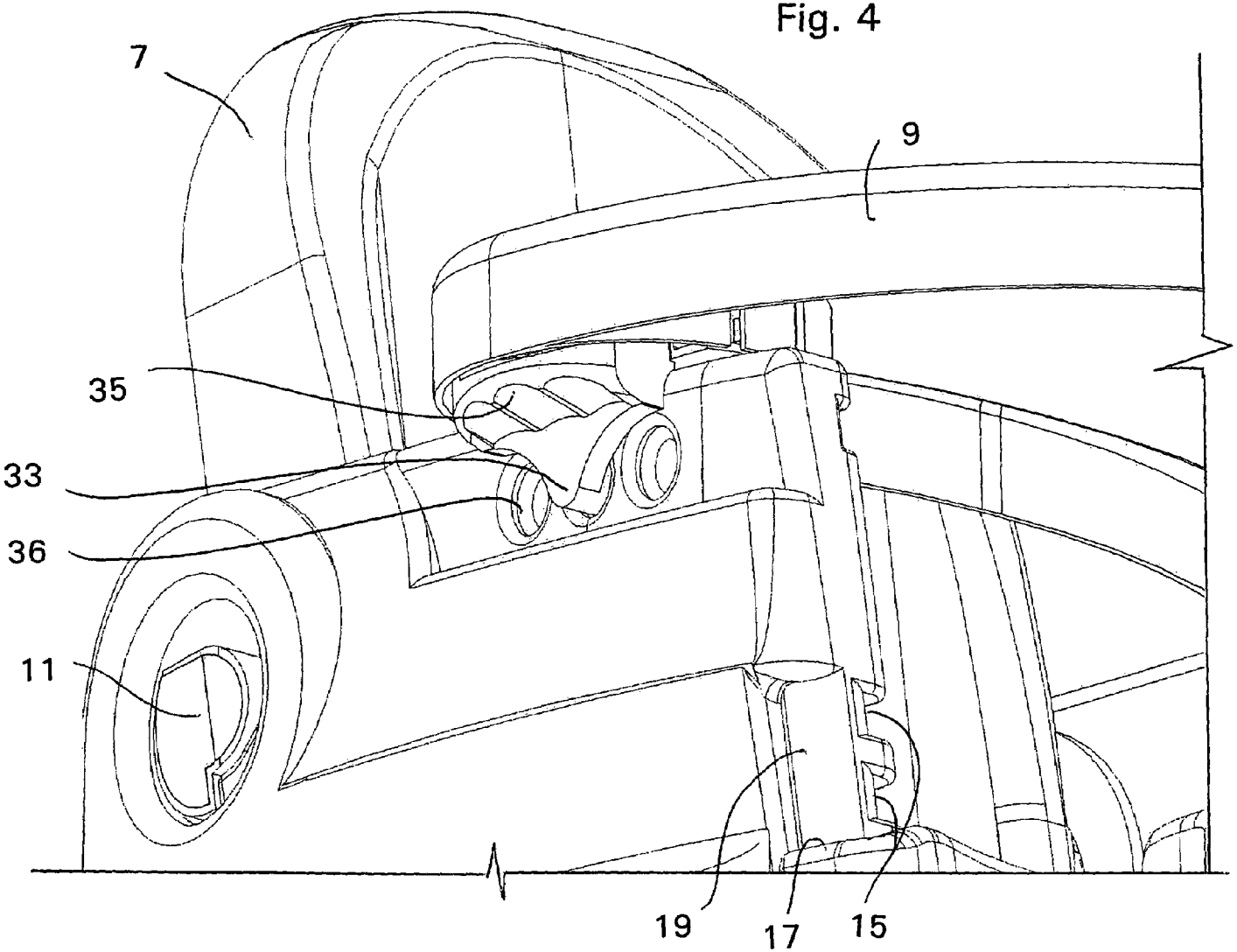
FIG. 4 is a partial perspective view of the underside of the swing tray and the biased detent portion of the swivel joint.

As shown in FIGS. 3 and 4, the seat member 3 is also adjustable to account for the changes in a child's height. A series of parallel and horizontal extending grooves 15 are formed in an inside portion of each of the arm rests 5, adjacent a lower edge of the arm rests 5. Any number of the horizontally extending grooves 15 being aligned vertically adjacent one another on each of the arm rests 5. The seat member 3 has opposing side edges, which are formed to slidably mate with and be supported in relative opposing grooves 15 in each of the arm rests 5. The height adjustment can be performed by slidably disengaging the seat member 3 from the opposing parallel grooves 15 in which it is currently supported, i.e., sliding the seat member 3 out the front of the booster chair 1 from between the arm rests 5, and reinserting the seat member 3 by simply pushing it into another desired pair of opposing grooves 15 at a different height.

A protruding corner portion 17 of the sides of the seat member 3 are configured to be received in a front slot 19 formed in the arm rests 5, such that the seat member 3 and arms 5 interlock. The seat member 3 may be provided with a crotch restraint 21 on a forward edge thereof to allow a child's legs to hang across the forward edge of the booster seat 1 and restrain the child from sliding off and over the forward edge of the seat member 3 and out of the booster seat 1. The seat member 3 can also contain at least one aperture 23 for the insertion of a retention strap to further secure the child and/or the booster seat 1 to a more stable support such as a chair, table or base structure.

As discussed above, the arm rests 5 function as main support components to which the seat member 3, protrusions 11 and back member 7 engage and interlock. The arm rests 5 also define a top edge which is arranged at a height relative to the bottom edge and the horizontally extending grooves which will assist in retaining a seated child in the booster seat 1. The top edge of the arm rests 5 serves not only as a support for a child's arms, but also to support the pivotable feeding tray 9 as discussed in further detail below. Additionally, apertures may be formed in the arm rests 5, usually near the lower edge thereof, to allow for a strap or plurality of straps to better fasten the booster seat 1 into a more stable position with a supporting chair or other support.

An important part of the present invention is the pivotable feeding tray 9 upon which generally the food and utensils or even play toy articles for an infant, toddler or child are supported. The tray 9 has a top surface which can be substantially flat and/or provided with a depression defined by a circuitous raised edge to assist in maintaining such articles on the top surface of the tray 9. The depression can be formed in a variety of shapes to accommodate particular articles, for example, cups and bowls, and also to provide such space as necessary to accommodate the swing joints 31 as described in further detail below.

The tray 9 has an outer edge 25 which may be provided in a variety of shapes. In the described embodiment, the outer edge 25 comprises an arcuate inner edge and a similar arcuate outer edge joined by a hyperbolic, curved edge on each side of the tray 9. It is to be appreciated that the outer edge 25 could be any number of different and ergonomic shapes and consists of multiple edges, e.g., rectangle or a hexagon.

The tray 9 is connected to the booster seat 1, via a pair of spaced apart swivel joints 31, generally connected and located on an underside of the feeding tray 9. The critical features of the present embodiment is that the feeding tray 9 can pivot or swivel about either of the swivel joints 31 relative to the booster seat 1 and also adjust in a horizontal and parallel manner relative to the back member 7 and hence the child accommodated in the booster seat 1. The feeding tray 9 is thus equally adjustable on each side by way of the swivel joints 31, which not only permit the rotation of the feeding tray 9 about one or the other swivel joints 31 relative to the booster seat 1, but also facilitate the horizontal and parallel adjustment of the feeding tray 9 relative to the back member 7 as well.

Horizontal and parallel adjustment of the feeding tray 9 is accomplished by moving the feeding tray 9 either closer to or farther from the seat member 3 by actuation of both swivel joints 31 at the same time and moving both sides of the tray 9 in a parallel manner either closer to or farther away from the back member 7 in a way for which a more complete description is provided below. The feeding tray 9 and booster seat 1 is, therefore, able to safely accommodate almost any size the child in the seat 1.

Figure 2:
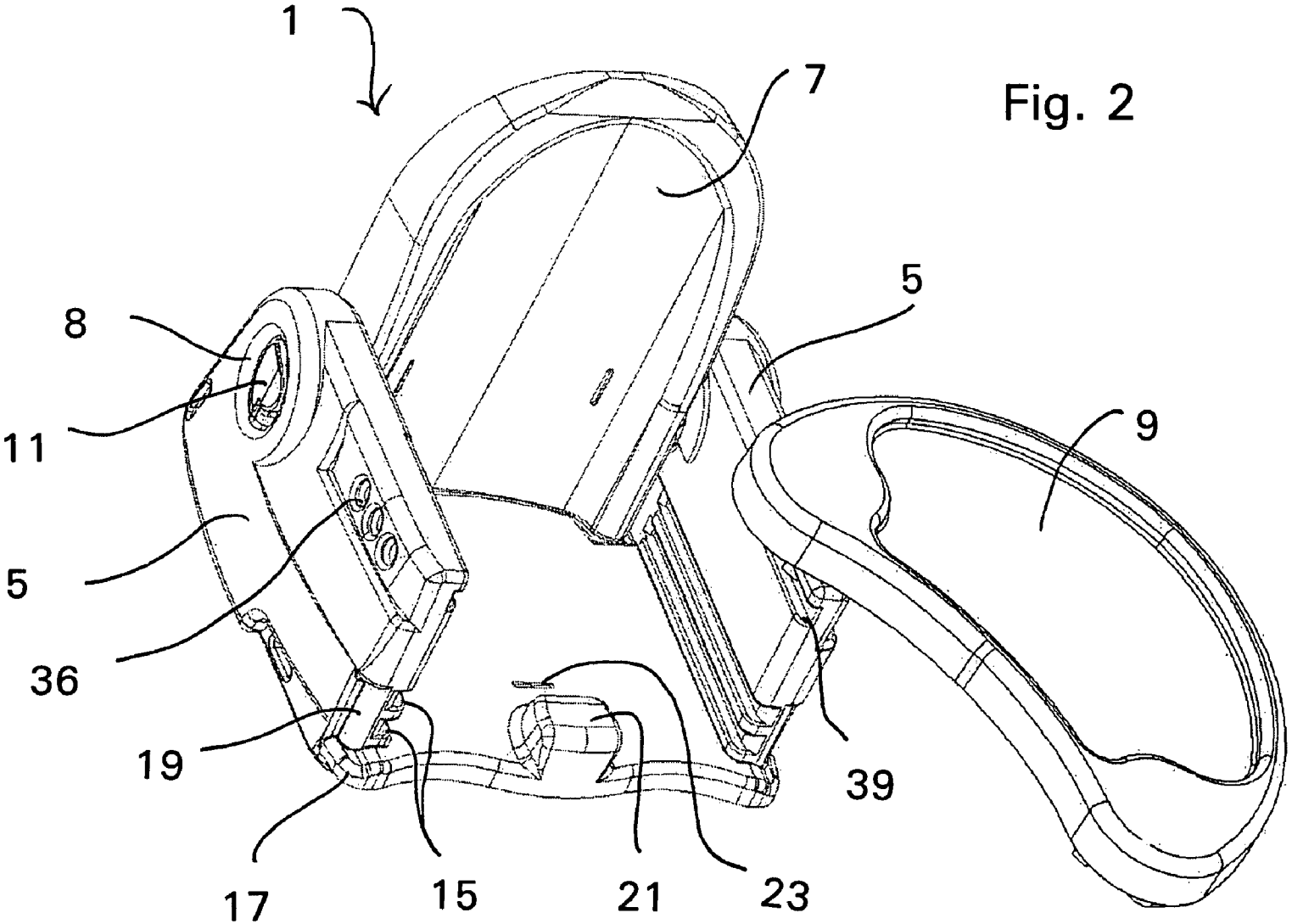
FIG. 2 is a further perspective view of the booster seat and swing tray in a partially open configuration to one side.
Figure 5:
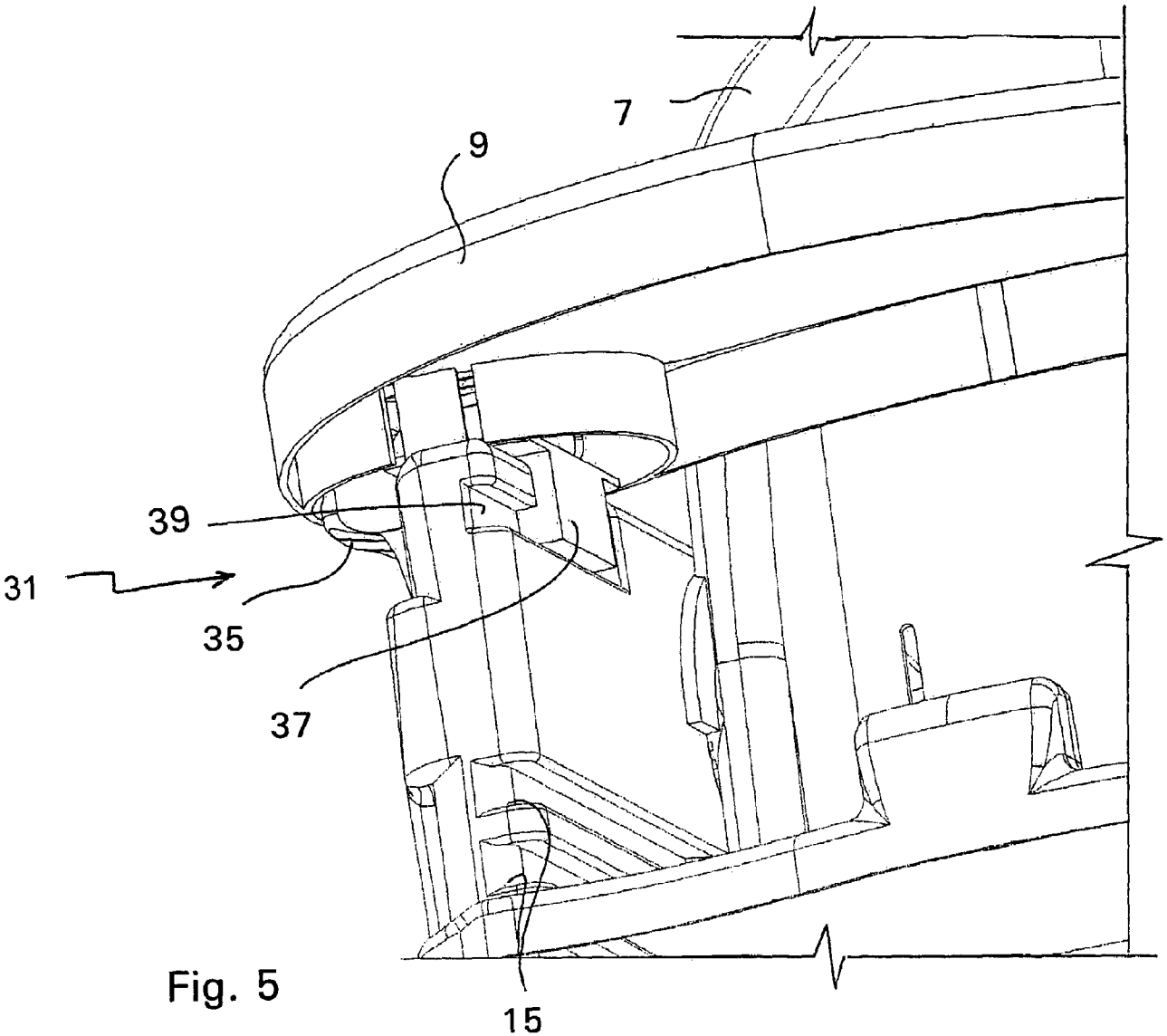
FIG. 5 is a partial perspective view of the underside of the swing tray and a slide and track portion of the swivel joint.

As shown in FIGS. 2 and 3, the feeding tray 9 can pivot about either of the spaced apart swivel joints 31 while the opposite swivel joint 31 is released from engagement with the booster seat 1. Turning to FIGS. 4 and 5, one of the swivel joints 31 is shown engaged with the arm rest 5. On one side, as shown in FIG. 4, the swivel joint 31 is provided with a spring biased detent 33 for selectively engaging a notch 36 formed in the outer side of the arm rest 5 and an ergonomic grip 35 may be provided as an actuator for the spring biased detent 33.

On the opposing side of the swivel joint 31, as seen in FIG. 5, the swivel joint 31 is provided with a slide 37 for engaging in a track 39 formed on an inner side of the arm rest 5. The slide 37 is generally held fixed, relative to the tray 9, when the spring biased detent 33 is actuated to enable parallel adjustment of the tray 9. The slide 37 thus generally remains engaged with the track 39 in the arm rest 5 during adjustment of the tray 9.

Thus, with one of these swivel joints 31 on each arm rest 5 of the booster seat 1, the feeding tray 9 can be horizontally and parallel adjusted for accommodating different sized occupants by actuating the spring biased detent 33 on each of the spaced apart swivel joints 31 into a non-engaged position with the notch 36, and sliding the swivel joint 31, slide 37 and feeding tray 9 along the track 39 formed in the arm rest 5 into a desired position relative to the seat back 7. Also, with the pair of swivel joints 31 in the non-engaged position, the feeding tray 9 may even be removed completely from slidable engagement with the booster seat 1 to facilitate cleaning or removal of the occupant.

When an appropriate adjustment of the feeding tray 9 relative to the back member 7 or the occupant is completed, the spring biased detent 33 is released and the detent is springably biased into the engaged position in a respective notch 36 in the arm rest 5 for securing the feeding tray 9 in the desired position.

Figure 6:
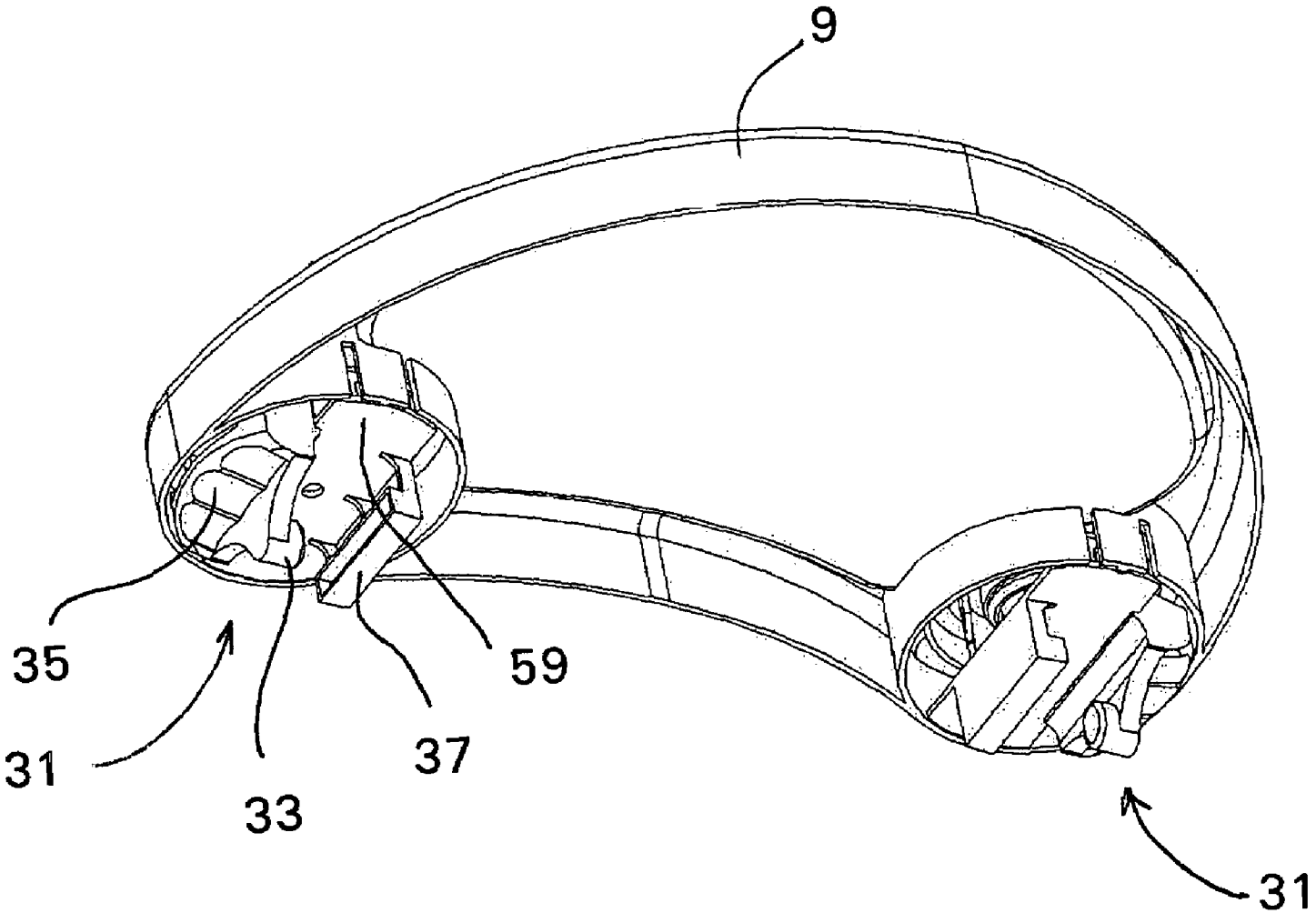
FIG. 6 is a perspective view of the underside of the swing tray and swivel joints.

Besides being slidable, the swivel joints 31 also allow the feeding tray 9 to swing about one or the other of the opposed swivel joints 31. To understand this feature of the invention, we provide the following description relative to the engagement of the swivel joint 31 in the feeding tray 9. The feeding tray 9 is configured to receive each of the swivel joints 31 generally in the underside of the tray 9 itself. A pair of pivot housings 41 are formed on an underside portion of the feeding tray 9 wherein the swivel joint 31 can reside. As seen in FIG. 6, the pivot housings 41 can be circular in design to correspond with the arcuate or circular motion of the swivel joint 31. The pivot housing 41 has at least an outer wall 43 for generally circumferentially containing the swivel joint 31 assembly therein. A central passage 45 for receiving an appropriate portion of the swivel joint 31 is formed in the pivot housing 41, and the central passage 45 may extend partially or completely through the feeding tray 9, as shown. Where the central passage 45 extends all the way through the feeding tray 9, a cap or cover may be provided on the top surface of the feeding tray 9 to cover the swivel joint 31 and the passage 13 from the occupant and for other aesthetic and functional conditions, as necessary.

The pivot housing 41 may also include an intermediate guide wall 47 and an intermediate stop 49. The intermediate stop 49 may be a partially circumferential wall or other such protrusion as is known in the art. The intermediate stop 49 depends downwards from the pivot housing 41 and provides a stop 49 or abutment against which an appropriate portion of the swivel joint 31 abuts to stop the rotation of the swivel joint 31, and hence the feeding tray 9, relative to the pivot housing 41. For all intensive purposes, the swivel joint 31 rotates within the pivot housing 41, however in use, the swivel joint 31 is biasely engaged by the spring biased detent 33 against the arm rests 5 of the booster seat 1 and the feeding tray 9 and the swivel housing formed therein, are rotated about the swivel joint 31. The intermediate stop 49 is necessary to maintain the rotation of the feeding tray 9 within proscribed limits when one swivel joint 31 is released to permit rotation of the feeding tray 9 about the other swivel joint 31.

Figure 7:
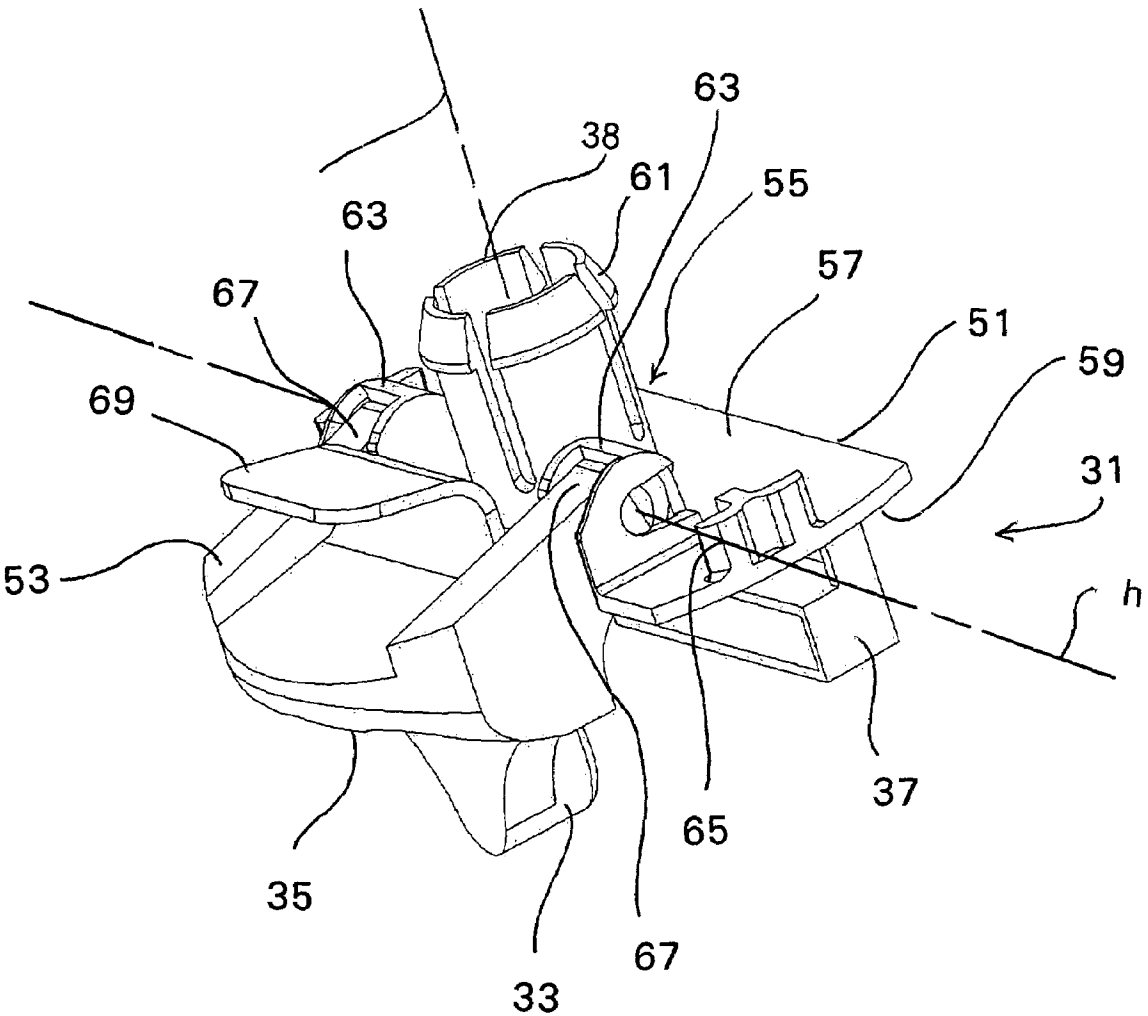
FIG. 7 is a perspective view of one of the swivel joints.
Figure 8:
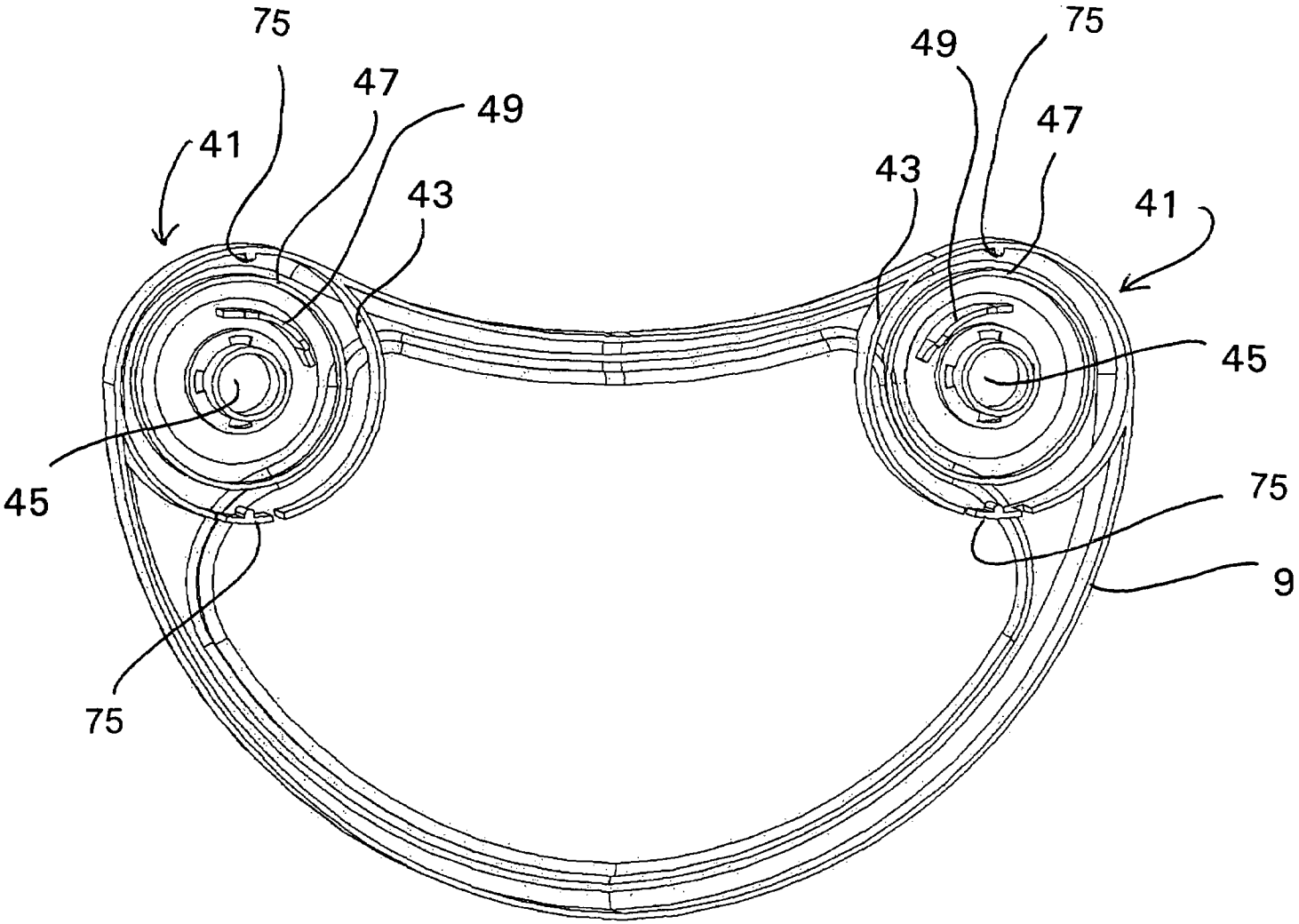
FIG. 8 is a perspective view of the underside of the swing tray and the pivot housing without the swivel joints.
Figure 9:
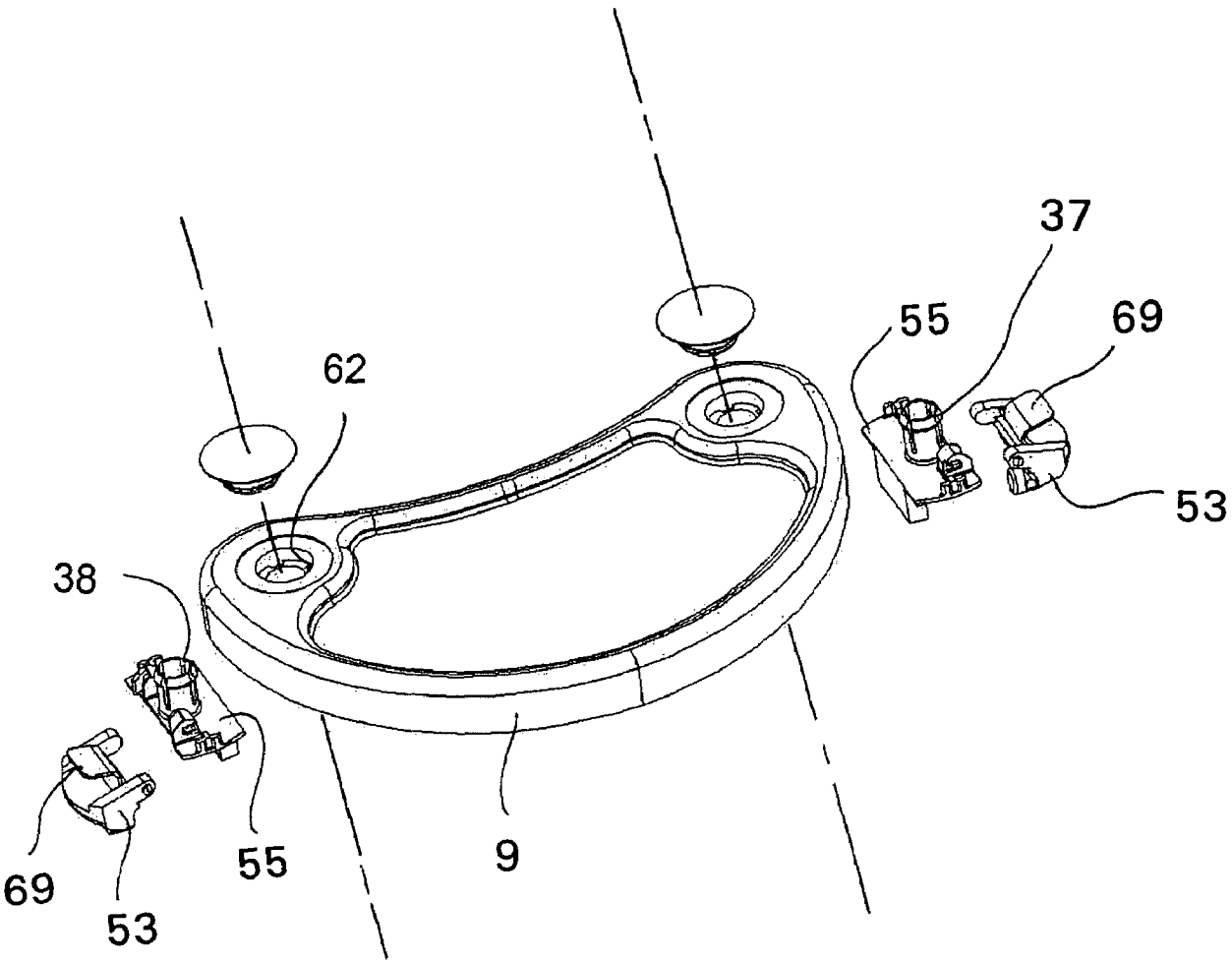
FIG. 9 illustrates an exploded view of an embodiment with a tray and joint combination.

The swivel joint 31 nests within the pivot housing 41 and is secured therein by a stem 38 extending from the swivel joint 31 and being received within the central passage 45 in the pivot housing 41. Observing FIG. 7, the swivel joint 31 is composed of two relatively moveable portions, a slide portion 51 and a detent portion 53. The slide portion 51 includes the slide 37 as discussed above, and correspondingly the detent portion 53 includes the springably biased detent 33 as also discussed above. The slide portion 51 has a base 55 with an upper surface 57 and a lower surface 59. The slide 37 depends from the lower surface 59 and can be generally formed as an L-shaped member which is attached to the lower surface 59 of the base 55 near an outer edge thereof.

The upper surface 57 of the base 55 supports the stem 38 which is shown in the present embodiment as a cylinder having a series of axial slots formed therein to provide the cylinder with a modicum of radial flexibility. The stem 38, along with the central passage 45, defines a swivel axis S about which the feeding tray 9 and/or the swivel joint 31 rotate with respect to one another. Also a free end of the stem 38 is provided with a catch 61, for instance, a slope portion and a ledge portion, for securing the stem 38, and hence the swivel joint 31, within a lip 62 or edge of the central passage 45 in the pivot housing 41.

Also positioned on the upper surface 57 of the base 55 are a pair of hinge supports 63 located on either side of the stem 38, and a pair of detent engagements 65 also spaced apart on either side of the stem 38 and radially beyond the hinge supports 63. The hinge supports 63 engage a corresponding hinge arms 67 of the detent portion 53 so as to define a pivot hinge axis h about which the slide portion 51 and the detent portion 53 are relatively hinged. The detent portion 53 also supports a spring mechanism 69 in the present embodiment a leaf spring, although other types of biasing mechanisms could be used as well, which is sandwiched between the detent portion 53 so as to bias the ergonomic grip 35 and the detent 53 against the underside of the feeding tray 9 and about the pivot hinge axis h so as to provide spring bias to the detent portion 53 when the swivel joint 31 is secured within the pivot housing 41.

When the stem 38 is affixed within the central passage 45 and the swivel joint 31 is then secured in the pivot housing 41 the leaf spring pushes the detent portion into engagement with the notch in the arm rest so as to secure the swivel joint to the arm rest. The ergonomic grip provides a surface for a user to pull up on against the inherent bias of the leaf spring and rotate the detent portion 53 relative to the slide portion 51 about the pivot hinge axis h and so as to release the detent 53 from engagement with the notch 36 and permit sliding movement of the swivel joint 31 relative to the arm rest 5. It is to be noted that the pivot hinge axis h about which the detent portion 53 rotates, is perpendicularly aligned relative to the swivel axis S about which the entire swivel joint 31 rotates relative to the feeding tray 9. These axes which provide the dual capability of the swivel and adjustment features of the present invention can be positioned perpendicular intersecting or offset from another as well.

To assemble the feeding tray 9 and swivel joint 31, the swivel joint 31 including the detent portion 53 hingedly connected to the slide portion 51 is inserted within the outer wall 43 of the pivot housing 41. The stem 38 is inserted within the central passage 45 until a point where the sloped end and ledge engage a correspondingly opposed lip 62 formed in the passage 45 so as to axially secure the stem 38 within the central passage 45. This coupling occurs because the slots 40 permit a degree of elasticity to the cylindrical stem 38 and permit the free end of the stem 38 to be axially affixed by the opposing lip 62 in the central passage 45. This arrangement, of course, still permits relative radial rotation between the stem 38 and the central passage 45 about the swivel axis S defined by the stem 38. With the stem 38 thus engaged, the swivel joint 31 is prevented from moving further axial movement because of the base 55 of the slide portion 51 being braced against a bottom edge of the inner wall defining the central passage 45 in the pivot housing 41.

With the swivel engaged in the pivot housing 41, as described above, the detent engagement 65 is provided with a snap fitting which extends in a substantially perpendicular direction from the base 55 and can be of almost any shape so long as it can make physical contact with a detent 75 formed in the pivot housing 41. The outer wall 43 of the pivot housing 41 is provided with the detent 75, which for example includes a slight rib formed on a segmented portion of the outer wall 43 to provide some inherent flexibility to the rib relative to the detent engagement 65 and snap fitting. When the swivel joint is rotated relative to the pivot housing 41 to a desired point, the snap fitting of the detent engagement 65 engages with the rib in the detent 75 and locks the swivel joint 31 into a relative position to the pivot housing 41 and hence the tray. This maintains the swivel joint in a desired position relative to the tray 9 so that for example after removal of the tray from the booster seat the swivel joint 31 does not move in the pivot housing 41, and the tray 9 can thus be easily engaged via attachment of the swivel joints 31 to the arm rests 5 with the booster seat. The locking action of the detent 75 and detent engagement 65 can be generally overcome by providing a slight force to overcome the engagement of these elements in a swiveling operation of the tray.

In addition, the stop 49 is radially centered about the swivel axis defined by the stem 38 and the central passage 45 at about the same radius as the hinge supports 63 on the base 55 so that at a desired point in the relative rotation of the swivel joint 3' and the feeding tray 9, the stop 49 and the hinge supports 63 will abut and impede further relative rotation in at least one direction. It is to be appreciated that the stop 49 and the hinge supports 63 are circumferentially spaced in a manner so as to provide a desired rotational freedom to the feeding tray 9. Although the stops 49 and hinge supports 63 may be provided in some circumferential spacing to account for different rotation angles, a preferred freedom of rotation or angle range for the feeding tray 9 is between about 60-180 degrees and more preferably about 120 degrees.

Thus, in use the feeding tray 9 as secured in an in-use position relative to an occupant of the booster seat 1 where the spaced apart swivel joints 31 define a vector therebetween which is parallel to the back member 7. When one of the swivel joints 31 is released from engagement with the respective arm rest 5, the feeding tray 9 is free to swing about the other opposite swivel joint 31. The feeding tray 9 can swing freely about the swivel or may be inhibited to a desired angle of rotation by the stop 49 and hinge supports 63 in the swivel joint 31 and the pivot housing 41. For example, the stop 49 and hinge supports 63 may be placed in such a position that the feeding tray 9 cannot rotate towards an occupant of the booster seat 1 past the parallel vector position, nor away from an occupant more than 120 degrees so as to facilitate removal of the occupant of the booster seat 1.

Concerning the back 7, base 55, and arms 5 of the seat 1, all of these structural members can be constructed of polymeric or composite materials, and can be produced by the processes of, for example, extrusion, injection molding, compression molding, or conventional machining. While a variety of different processes and materials can be used in the present invention, the above simply illustrate a preferred material arrangement.

Since certain changes may be made in the above description without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A booster seat for facilitating the feeding of an infant or child comprising:

a seat portion;

a back support portion;

a pair of arm rests; and a tray having a first and a second spaced apart swivel joints wherein the first and second swivel joints are defined by a vertical pivot axis substantially perpendicular aligned relative to a planar surface of the tray and the swivel joints on the tray are both releasably engaged directly with an immovable respective opposing arm rest of the booster seat, and the tray spans the opposing arm rests to permit horizontal rotation of the tray about either of the first and second swivel joints engaged with one of the respective arm rests of the booster seat;

each of the first and second swivel joints further comprise a base independently rotatable about the vertical pivot axis relative to the tray, and horizontally adjustable along the arm rest of the booster seat; and wherein the base of each of the first and second swivel joints further comprises a springably biased detent portion for engaging with an outer wall of the arm rests and a fixed slide portion for engagement with a contiguous track formed in an opposing inner wall of the arm rest.

2. The booster seat according to claim 1 wherein each said first and second swivel joints comprise an engagement axis between the slide and the spring biased detent about which the spring biased detent rotates relative to the slide.

3. The booster seat according to claim 2 wherein each said first and second swivel joints are positioned in a pivot housing formed in the tray of the booster seat.

4. The booster seat according to claim 3 wherein the swivel joint of each of said first and second swivel joints and the associated pivot housing comprise an interlocking cylinder arrangement permitting rotational movement between the swivel joint and the pivot housing.

5. A booster seat for facilitating the feeding of an infant or child comprising:

a seat portion;

a back support portion;

a pair of arm rests; and a tray having a first and a second spaced apart swivel joints wherein the first and second swivel joints are defined by a vertical pivot axis substantially perpendicular aligned relative to a planar surface of the tray and the swivel joints on the tray are both releasably engaged directly with an immovable respective opposing arm rest of the booster seat, and the tray spans the opposing arm rests to permit horizontal rotation of the tray about either of the first and second swivel joints engaged with one of the respective arm rests of the booster seat;

each of the first and second swivel joints further comprise a base independently rotatable about the vertical pivot axis relative to the tray, and horizontally adjustable along the arm rest of the booster seat; and wherein a springably biased detent portion of the base is hingedly connected to a slide fixed to said base about a substantially horizontally aligned hinge axis and the detent portion and the fixed slide rotate together about the vertical axis of the swivel joint each said first and second swivel joints.

6. The booster seat according to claim 5 wherein each said first and second swivel joints comprise an engagement axis between the fixed slide and the spring biased detent about which the spring biased detent rotates relative to the fixed slide.

7. The booster seat according to claim 6 wherein each said first and second swivel joints are positioned in a pivot housing formed in the tray of the booster seat.

8. The booster seat according to claim 7 wherein the swivel joint of each of said first and second swivel joints and the associated pivot housing comprise an interlocking cylinder arrangement permitting rotational movement between the swivel joint and the pivot housing.

* * * * *